United States Patent [19]

Brown et al.

[11] Patent Number: 5,002,426

[45] Date of Patent: Mar. 26, 1991

[54] PADDLE MIXER FOR ASPHALT PAVERS

[75] Inventors: Robert L. Brown, Mattoon; Tom Thomason, Charleston, both of Ill.

[73] Assignee: Blaw-Knox Construction Equipment Corporation, Matton, Ill.

[21] Appl. No.: 456,981

[22] Filed: Dec. 15, 1989

[51] Int. Cl.[5] ..... E01C 23/12

[52] U.S. Cl. ..... 404/92; 404/101; 404/108; 404/113; 404/115; 404/118

[58] Field of Search ..... 404/80, 77, 79, 83, 404/92, 95, 101, 102, 108, 113, 115, 118

[56] References Cited

U.S. PATENT DOCUMENTS

| | | | |
|---|---|---|---|
| 2,046,417 | 7/1936 | Talbot et al. | 404/92 |
| 2,059,607 | 11/1936 | Pullar et al. | 404/92 |
| 2,067,236 | 1/1937 | Hepburn | 404/92 |
| 2,328,888 | 9/1943 | Bell | 404/92 |
| 2,669,915 | 2/1954 | McConnaughay | 404/108 |
| 3,907,451 | 9/1975 | Fisher et al. | 404/118 |
| 4,708,519 | 11/1987 | Davin et al. | 404/108 |
| 4,749,304 | 6/1988 | Craig | 404/101 |
| 4,772,156 | 9/1988 | Craig | 404/101 |
| 4,818,139 | 4/1989 | Brock et al. | 404/108 |

OTHER PUBLICATIONS

Brock, J. D., Hot Mix Asphalt Segregation: Causes and Cures, Natl. Asphalt Pavement Assoc., Riverdale, Md. (QIP 110) (1986).

*Primary Examiner*—Ramon S. Britts
*Assistant Examiner*—Roger J. Schoeppel
*Attorney, Agent, or Firm*—Pearne, Gordon, McCoy & Granger

[57] ABSTRACT

A revolving paddle mixer for re-mixing a hot asphalt mix deposited in the hopper of a road paving machine. The mixer takes the form of a plurality of paddles angularly positioned relative to each other and mounted on a revolving shaft adjacent to the conveyor for transporting the asphalt mix material to the rotating auger. The resultant re-mixture is more uniform and dense so that a smooth pavement is laid on the roadway.

4 Claims, 4 Drawing Sheets

PADDLE MIXER FOR ASPHALT PAVERS

The present invention relates to a revolving paddle mixer for re-mixing a hot asphalt mix deposited in an asphalt paving machine so that the resulting pavement is more uniform and dense.

BACKGROUND OF THE INVENTION

A long standing problem in the field of preparing hot mix asphalt for paving is to eliminate segregation of the paving mixture so that the smoothness of the finished pavement is assured. Segregation in a hot asphalt paving mix may occur during the manufacture of the mix, as well as during hauling in a truck and dumping into the paver hopper. Smoothness of the final pavement mat is important since it effects the initial riding quality over the pavement, and poor asphalt mat quality can also effect pavement performance in which cracks occur and low spots are present were water can collect. In addition, poor joints and other defects contribute to the deterioration of a hot mix asphalt layer. This problem has been recognized by the National Asphalt Pavement Association of Riverdale, Md. in their publication entitled "Hot Mix Asphalt Segregation:" Causes the Cures, reprinted in September, 1988.

SUMMARY OF THE INVENTION

The present invention has addressed the above described problem by recognizing that hot asphalt paving mix contains small and large gravel as well as rock and stones of various sizes. Consequently, when a pile of hot asphalt mix is deposited in the hopper of a asphalt paving machine the pile takes the shape of a pyramid and the larger stones and gravel fall down the sides of the pyramid to collect on either sides of the paving machine hopper, as well as the front and back of the pile while the lighter stones and gravel remain on top of the pile. Consequently, when the asphalt paving mix pile is then moved by means of a conveyor to the rotating auger the larger stones and gravel are not mixed with the smaller stones to create a uniform pavement mix, and therefore the segregated mix causes inconsistency when the asphalt pavement mat has been layed by the paving machine. Thus, when segregation is present, there is a concentration of coarse materials in some areas and fine materials in others resulting in a non-uniform mix which does not achieve the smoothness required for present day roadways.

It is the object of the present invention to provide revolving paddles in a hopper of an asphalt paver machine to remix the paving material to a homogeneous consistency before the screed places the mix on grade. This will result in a more uniform and dense pavement than has heretobefore been achieved.

Another object of the present invention is to provide a paddle mixer for asphalt pavers having a plurality of revolving flights in which the flights are angularly disposed relatively to each other.

A further object of the present invention is to provide a revolving paddle mixer which is a self contained unit that can be installed in the hopper of a new asphalt paving machine, or retro-fitted on a used machine.

Another object of the present invention is to use the hydraulic power present in an asphalt paving machine in order to drive the rotating mixer paddles whereby the asphalt paving mix is remixed to a more homogeneous state before the horizontally disposed conveyor delivers the mixed material to the distribution augers, and subsequently to the screed for laying a pavement mat.

It is thus a principal feature of the present invention to provide a paving mix of consistent density, thus essentially removing bumps and ripples in the final pavement.

BRIEF DESCRIPTION OF THE DRAWINGS

In order that the invention may be more clearly understood, it will now be disclosed in greater detail with reference to the accompanying drawings in, in which.

DESCRIPTION OF THE PREFERRED EMBODIMENT

Figure 3:
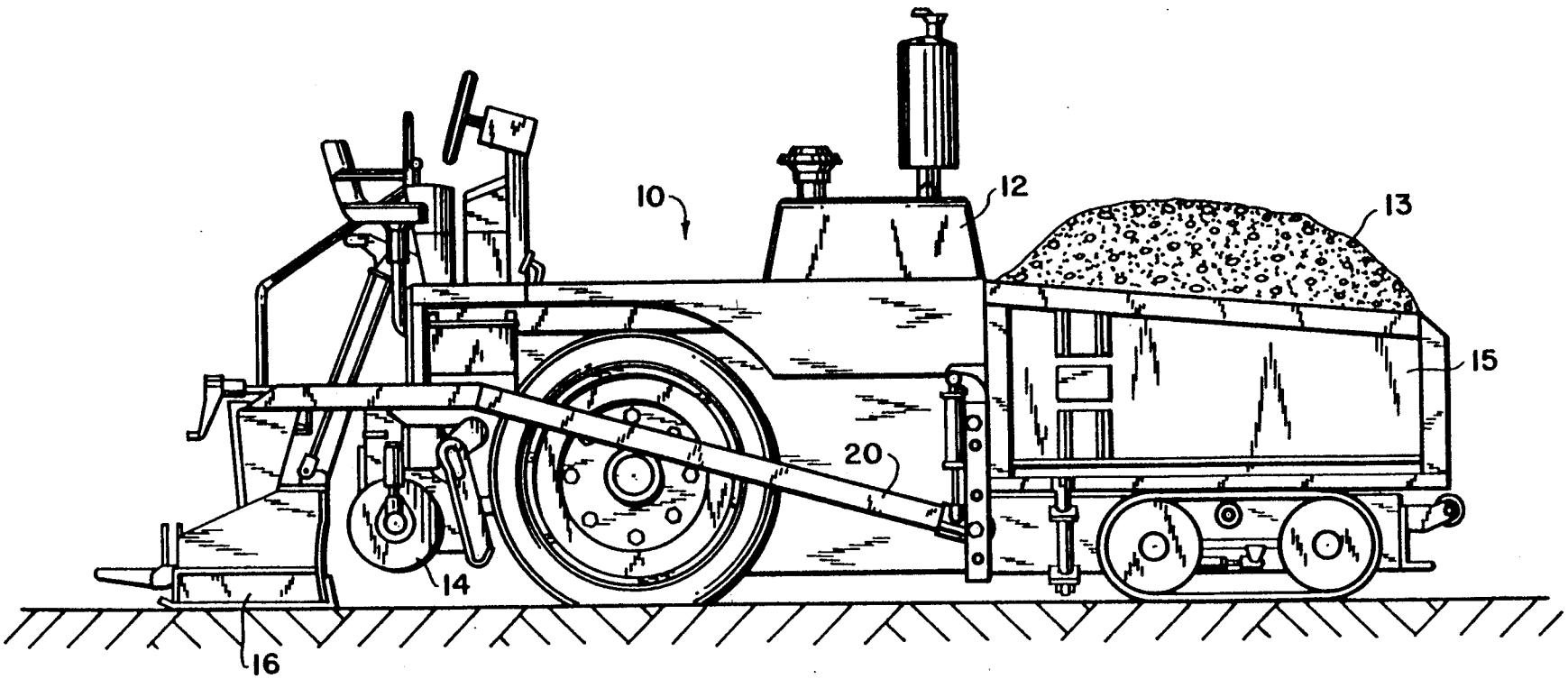
FIG. 3 is a side elevational view of an asphalt paving machine showing a pile of hot asphalt mix deposited in the hopper of the machine.

Referring to FIG. 3 of the drawings, the asphalt paving machine 10 is shown which is self-propelled by an engine 12, and is provided at its forward end with a load carrying hopper 14 for receiving hot asphalt paving material 13 from a dump truck (not shown) which is typically positioned directly in front of the paver. The paver is further provided with an auger 14, and a floating screed 16. When operating, the asphalt paver pushes the truck having a load of hot asphalt mix along the road bed with the truck continually discharging asphalt paving material into the hopper 15. As particularly seen in FIG. 5, the paving material is conducted by horizontally arranged slat conveyors 18 through the hopper and deposited on the rotating auger 14 (illustrated in FIG. 3) in order to be spread on the roadway in the well-known way. The screed is shown attached to the paver by tow arms 20 (also illustrated in FIG. 3).

A self contained paddle mixer referred to generally by the numeral 22 is located within the paver hopper and preferably in the rear thereof adjacent to the gates permitting a controlled amount of asphalt mix to be passed on the conveyors to the rotating auger. The paddle mixer, hereinafter more fully described, forms the basis for the present invention, and is adapted to be connected to a hydraulic system of the asphalt paver for power to rotate the mixer paddles.

As referred to hereinbefore, the long standing problem which has never been satisfactorily solved in preparing hot mix asphalt for paving is to eliminate the segregation of the paving mixture so that a more homogeneous asphalt mix is achieved. It is believed that the present invention achieves a practical solution by supplying a selfcontained paddle mixing construction which can be mounted in the hopper of an asphalt paving machine for re-mixing material deposited in the hopper so that the mixture will be more uniform when placed on grade by the screed of the paving machine.

Figure 1:
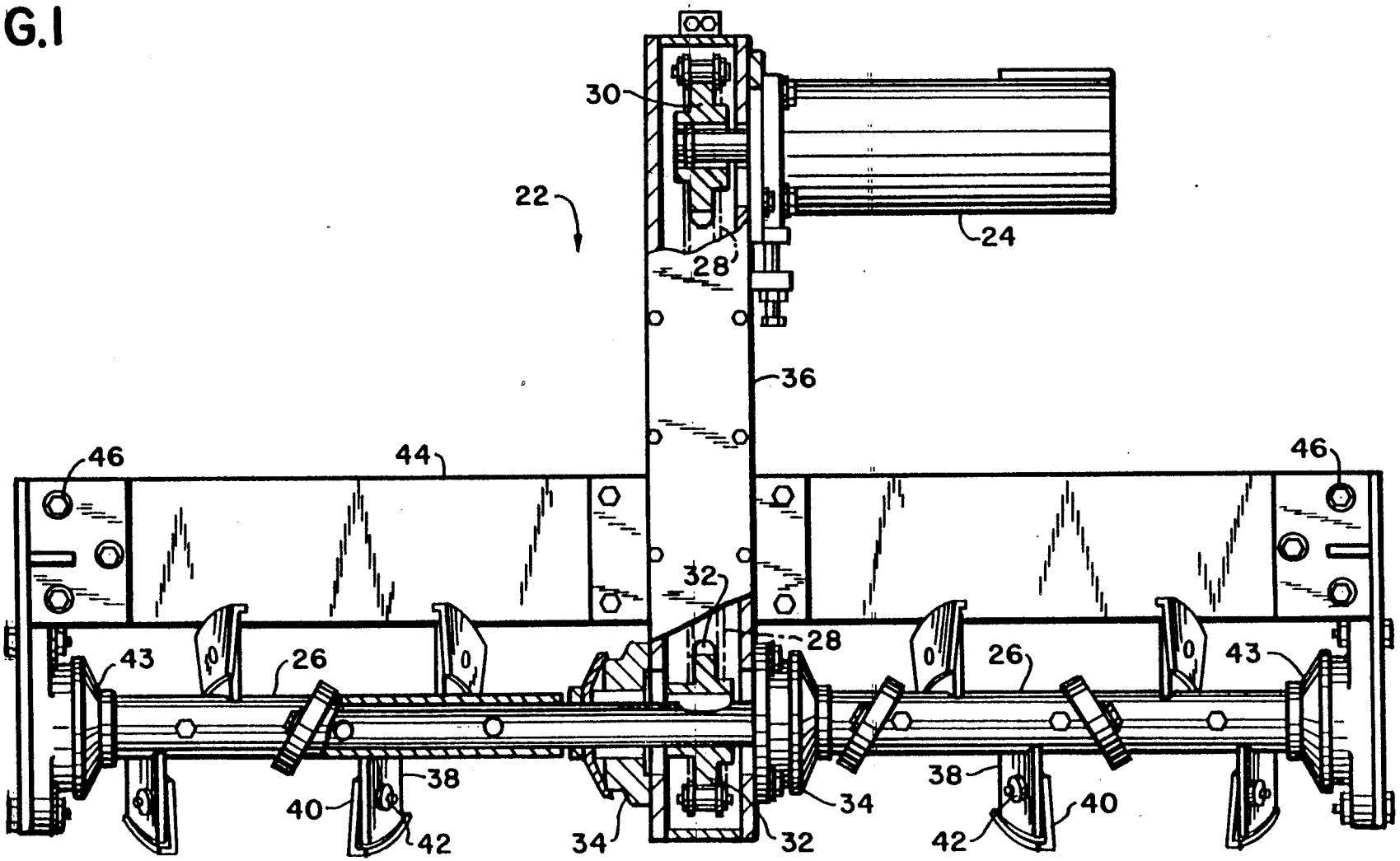
FIG. 1 is a front elevational view, partially in section, of the self contained paddle mixer for asphalt pavers constructed in accordance with the teachings of the present invention.
Figure 2:
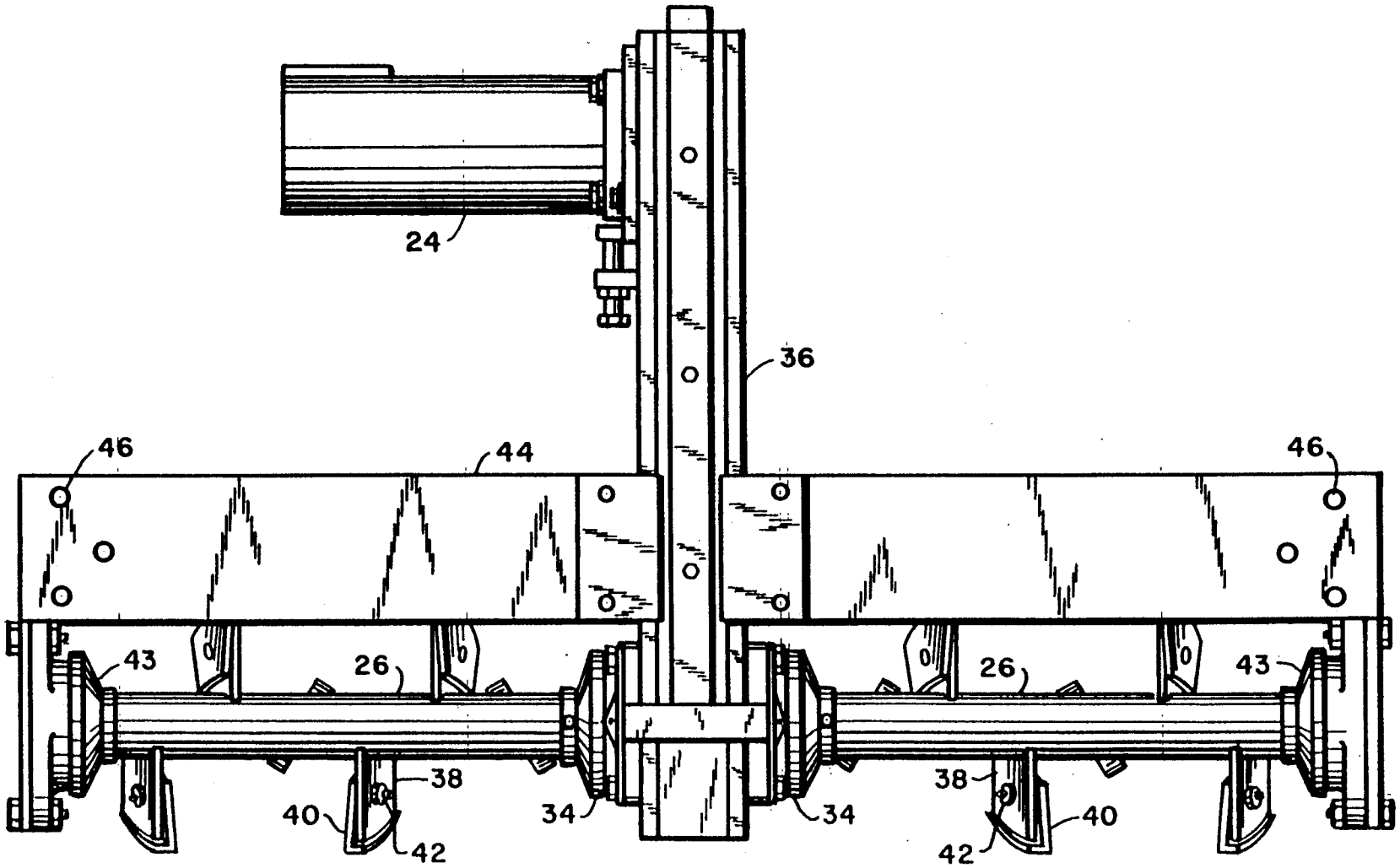
FIG. 2 is a rear elevational view thereof.
Figure 4:
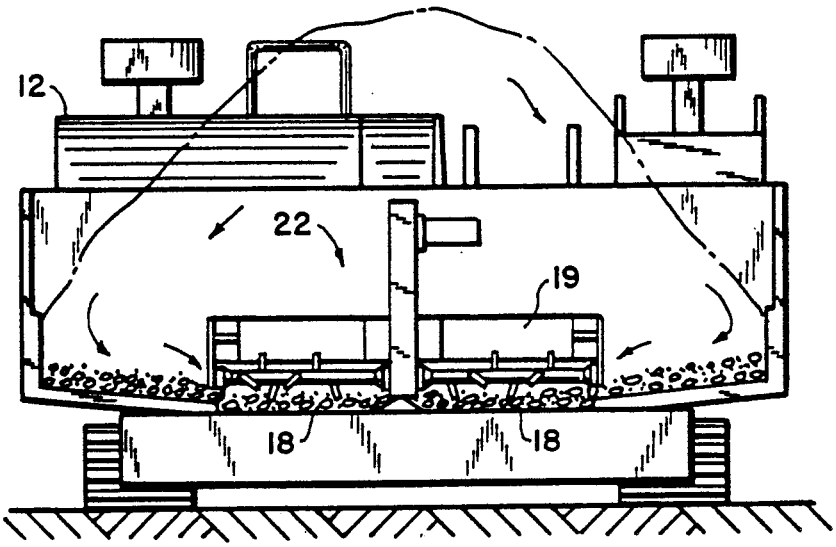
FIG. 4 is a rear elevational view of the asphalt paving machine diagrammatic form showing the paddle mixer in the rear of the asphalt paver hopper and showing the asphalt pile in which the larger stones and gravel fall down the sides and front and back of the pile and adjacent to the bed and sides of the hopper.

As seen in FIGS. 1, 2 and 4 the paddle mixer referred to generally by the reference numeral 22 is provided with a hydraulic motor 24 which drives a rotatable shaft 26 by means of a chain 28 fitted around upper sprocket wheel 30 and lower sprocket wheel 32. The drive shaft 26 is journalled in bearings 34 mounted on opposite sides of the bottom of housing 36 for the chain drive. A plurality of paddle mounts 38 are secured in spaced relationship on the drive shaft 26 and are angularly positioned relatively to each other. On each paddle mount 38, a paddle tip 40 is removably secured by means of a bolt 42. On opposite ends of the shaft 26 are located dirt shields 43. Furthermore, secured at either end of the shaft 26, and adjacent to the dirt shields 43, is a rectangular-shaped mounting plate 44 which is fixed to the back of the housing 36. The mounting plate 44 is therefore held to the rear wall of the hopper 15 by means of bolts 46. It should be apparent that, although the self-contained paddle mixer for asphalt pavers is shown affixed to the rear wall of the hopper of a paver machine, it may be placed at other selected locations on the paver as long as it effectively re-mixes the asphalt paving mixture to the desired consistency.

Figure 5:
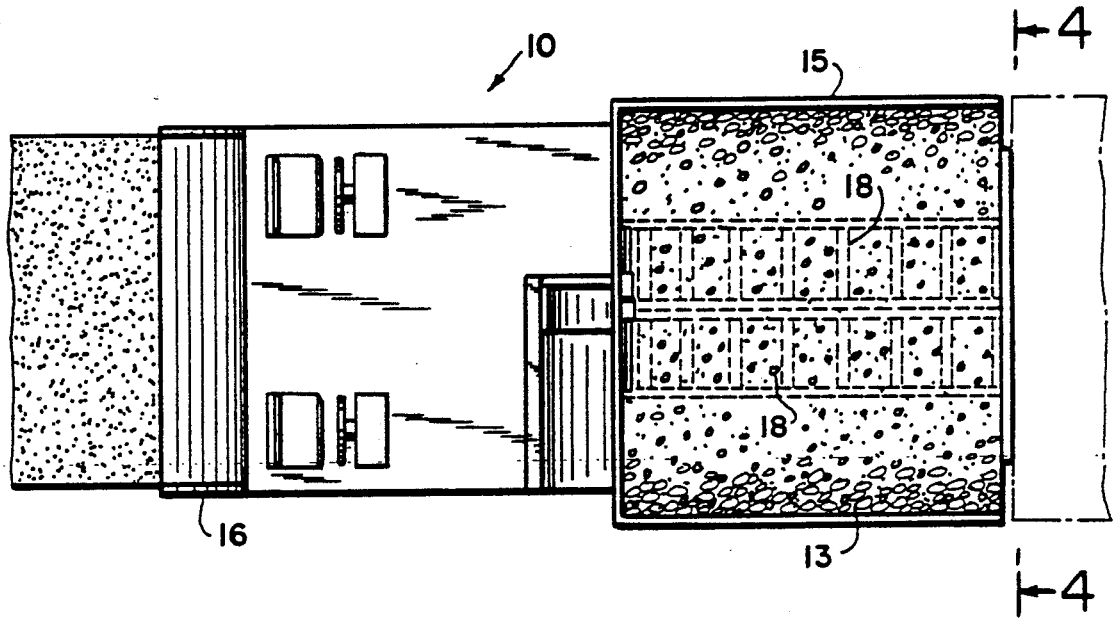
FIG. 5 is a plan view of the machine illustrating the paving mix within the hopper, a portion of a conveyor which transports the paving mix from the hopper, and the screed which levels the paving mix on the road bed. In this Figure, the tow arms for the screed are eliminated for purposes of clarity.

As seen in FIG. 5 the hot asphalt paving mix is dumped into the hopper 15 and conducted by conveyors 18 through the hopper gate or flow gate 19 (illustrated in FIG. 4). However, prior to movement of the asphalt mix through the hopper gate 19, the paddle mixer of the present invention is utilized to re-mix the asphalt mixture to avoid segregation and to achieve the uniform mixture with required smoothness for present day roadways. The resultant homogeneous mixture is shown on the left end of FIG. 5 whereby this homogeneous mixture is delivered to the rotating augers to be spread on a road bed with the result that the pavement which is layed down is more uniform and dense than heretofore has been achieved.

While the invention has been disclosed and described herein with reference to a certain number of embodiments, it is apparent that variations and modifications may be made which fall within the true spirit and scope of the invention, as defined in the following claims:

We claim:

1. In an asphalt paving machine having a hopper, a conveyor, a rotatable distribution auger and a screed, the improvement comprising:

a paddle mixer assembly mounted in said hopper, means for revolving said paddle mixer whereby when a hot mix asphalt pile of material is supplied to said hopper and transported on said conveyor into engagement with said revolving paddle mixer said asphalt material is remixed into a homogeneous state before said conveyor further delivers the material to said distribution auger and screed.

2. An asphalt paving machine as claimed in claim 1 wherein said paddle mixer is provided with a plurality of paddles which are spaced and angularly disposed relative to each other.

3. An asphalt paving machine as claimed in claim 1 wherein said hopper is provided with flow gates for controlling the amount of not mix asphalt conveyed to said augers, and said paddle mixer assembly being mounted adjacent to said flow gates.

4. An asphalt paving machine as claimed in claim 3 further comprising a rotatable shaft for said paddles extending substantially horizontally over said conveyor and in close proximity thereto.

* * * * *